US009368860B2

(12) United States Patent
Hossain

(10) Patent No.: US 9,368,860 B2
(45) Date of Patent: Jun. 14, 2016

(54) PATCH ANTENNA

(71) Applicant: FUJITSU LIMITED, Kawasaki-shi, Kanagawa (JP)

(72) Inventor: Md.Golam.Sorwar Hossain, Edogawa (BD)

(73) Assignee: FUJITSU LIMITED, Kawasaki (JP)

( * ) Notice: Subject to any disclaimer, the term of this patent is extended or adjusted under 35 U.S.C. 154(b) by 207 days.

(21) Appl. No.: 14/151,548

(22) Filed: Jan. 9, 2014

(65) Prior Publication Data

US 2014/0197994 A1 Jul. 17, 2014

(30) Foreign Application Priority Data

Jan. 11, 2013 (JP) ..... 2013-004007

(51) Int. Cl.

| | |
|---|---|
| ***H01Q 1/38*** | (2006.01) |
| ***H01Q 1/27*** | (2006.01) |
| ***H01Q 9/04*** | (2006.01) |
| ***H01Q 21/28*** | (2006.01) |

(52) U.S. Cl.

CPC ..... *H01Q 1/273* (2013.01); *H01Q 9/0414* (2013.01); *H01Q 9/0421* (2013.01); *H01Q 21/28* (2013.01)

(58) Field of Classification Search

CPC ..... H01Q 1/241; H01Q 1/242; H01Q 1/243; H01Q 1/273; H01Q 5/30; H01Q 5/307; H01Q 5/40; H01Q 5/45; H01Q 9/0414; H01Q 9/0421; H01Q 21/28; H01Q 9/04; H01Q 1/27

USPC ..... 343/700 MS, 829, 830, 846

See application file for complete search history.

(56) References Cited

U.S. PATENT DOCUMENTS

| | | | | |
|---|---|---|---|---|
| 4,083,046 | A * | 4/1978 | Kaloi | H01Q 9/0407 343/700 MS |
| 4,162,499 | A * | 7/1979 | Jones, Jr. | H01Q 5/42 343/700 MS |
| 6,667,716 | B2 * | 12/2003 | Chen | H01Q 1/243 343/700 MS |
| 2003/0146872 | A1 | 8/2003 | Kellerman et al. | |

FOREIGN PATENT DOCUMENTS

| | | | |
|---|---|---|---|
| JP | 11-150415 | A | 6/1999 |
| JP | 2001-60823 | A | 3/2001 |
| JP | 2003-516011 | A | 5/2003 |
| JP | 2003-258540 | A | 9/2003 |
| JP | 2007-243416 | A | 9/2007 |
| WO | WO 01/39326 | A1 | 5/2001 |

* cited by examiner

*Primary Examiner* — Michael C Wimer
(74) *Attorney, Agent, or Firm* — Arent Fox LLP

(57) ABSTRACT

A patch antenna includes a ground electrode arranged on one surface of a dielectric layer, a first patch which has a shape of a trapezoid, is arranged inside the dielectric layer and radiates a signal having a first frequency, a second patch which has a shape of a trapezoid, is arranged on the other surface of the dielectric layer and radiates a signal having a second frequency, and two conductors which connect the short sides of the two patches with the ground electrode. The two patches are arranged such that the short sides are both located on the side of the same end of the dielectric layer. The first patch is fed power via a feeding point near the short side, and the second patch is fed power via a feeding point which is located between the end of the dielectric layer and the short side of the first patch.

3 Claims, 6 Drawing Sheets

PATCH ANTENNA

CROSS-REFERENCE TO RELATED APPLICATION

This application is based upon and claims the benefit of priority of the prior Japanese Patent Application No. 2013-004007, filed on Jan. 11, 2013, the entire contents of which are incorporated herein by reference.

FIELD

The embodiments discussed herein are related to a patch antenna which can be used in a plurality of frequency bands.

BACKGROUND

In recent years, a body area network (BAN) that communicates between a plurality of communication devices mounted on different locations of the human body has been studied. A BAN is expected to be applied to, for example, the health care field. For example, a small communication device that is connected to a biosensor mounted on a certain part of the human body such as the wrist communicates, by radio, with a controller mounted on another location of the human body, such as the trunk, and thereby transmits biological information that is acquired by the biosensor, to a controller. Then, the controller transmits biological information, with identification information of the person on which the controller is mounted or identification information of the controller, to a medical information management system placed in a medical facility, via, for example, a wireless communication channel.

In this way, in a BAN, communication devices are mounted on the human body, so that the antennas included in the communication devices are preferably small, and, in particular, the size in the direction that is perpendicular to the surface of the human body is preferably small. Furthermore, in the BAN, a plurality of communication devices may be mounted on the human body. In this case, respective communication devices use different frequency bands. Consequently, the antennas included in the communication devices to be utilized in the BAN are able to use a plurality of frequency bands.

Patch antennas that are small are able to use a plurality of frequency bands have been proposed (for example, see Published Japanese Translation of the POT International Publication for Patent Application (Kohyo) No. 2003-516011, Japanese Laid-Open Patent Publication No. 11-150415, Japanese Laid-Open Patent Publication No. 2001-60823 and Japanese Laid-Open Patent Publication No. 2003-258540). The patch antennas disclosed in these patent documents include a plurality of stacked planar conductors (patches).

SUMMARY

In the BAN, as the posture of the human body changes, the relative positional relationships between a plurality of parts of the human body where communication devices are mounted, may also change. Furthermore, the possibility is high that there are no other human body parts in the direction perpendicular to the surface of the human body, and therefore the possibility is high that there are no other communication devices mounted on the human body in the direction. Consequently, when communication devices mounted on the human body communicate, in a state an antenna is mounted on the surface of the human body, the antenna's radiation characteristics in the direction that is parallel to the surface of the human body are preferably better than the radiation characteristics in the direction that is perpendicular to the surface of the human body. Furthermore, the antenna preferably does not have directivity in a plane that is parallel to the surface of the human body.

In the BAN, one of the communication devices mounted on the human body, such as a controller, communicates not only with other communication devices mounted on the human body, but also with communication devices that are located somewhere other than the human body, such as a base station apparatus, using different radio frequencies. A communication device of this kind will be referred to as a "hub communication device" for ease of explanation. An antenna of a hub communication device needs to be able to radiate electric waves in the direction that is perpendicular to the surface of the human body in order that the hub communication device communicates with a communication device located somewhere other than the human body.

According to one embodiment, a patch antenna is provided. The patch antenna includes a dielectric layer, a ground electrode, which is arranged on one surface of the dielectric layer, a first patch, which is conductive, formed in a shape of a trapezoid, and arranged inside the dielectric layer, to be parallel with the ground electrode, and which transmits a signal having a first frequency, or receives the signal having the first frequency, a second patch, which is conductive, formed in a shape of a trapezoid, and arranged on the other surface of the dielectric layer, to be parallel with the first patch, and which transmits a signal having a second frequency, which is higher than the first frequency, or receives the signal having the second frequency, a first conductor, which electrically couples a short side of the first patch with the ground electrode, and a second conductor, which electrically couples a short side of the second patch with the ground electrode.

The first patch and the second patch are arranged such that the short side of the first patch and the short side of the second patch are located on a side of a first end of the dielectric layer and a long side of the first patch and a long side of the second patch are located on a side of a second end, which opposes to the first end, and the first patch is fed power via a first feeding point, which is closer to the short side of the first patch than the long side of the first patch, and the second patch is fed power via a second feeding point, which is located between the first end and the short side of the first patch.

The object and advantages of the invention will be realized and attained by means of the elements and combinations particularly pointed out in the claims.

It is to be understood that both the foregoing general description and the following detailed description are exemplary and explanatory only, and are not restrictive of the invention as claimed.

DESCRIPTION OF EMBODIMENTS

A patch antenna according to one embodiment will be explained with reference to the accompanying drawings. The patch antenna is a patch antenna which is able to use a plurality of frequency bands (which is also referred to as a "micro-strip antenna"), and includes a plurality of stacked patches of different sizes. To be adapted to a hub communication device used in a BAN, the patch antenna has excellent radiation characteristics in a plane that is parallel to the surface of the patch antenna, in the radio frequency used for communication between a plurality of communication devices mounted on the human body. Meanwhile, in the radio frequency used for communication between the hub communication device and communication devices located somewhere other than the human body, the patch antenna has excellent radiation characteristics in the direction that is perpendicular to the surface of the patch antenna.

Figure 1:
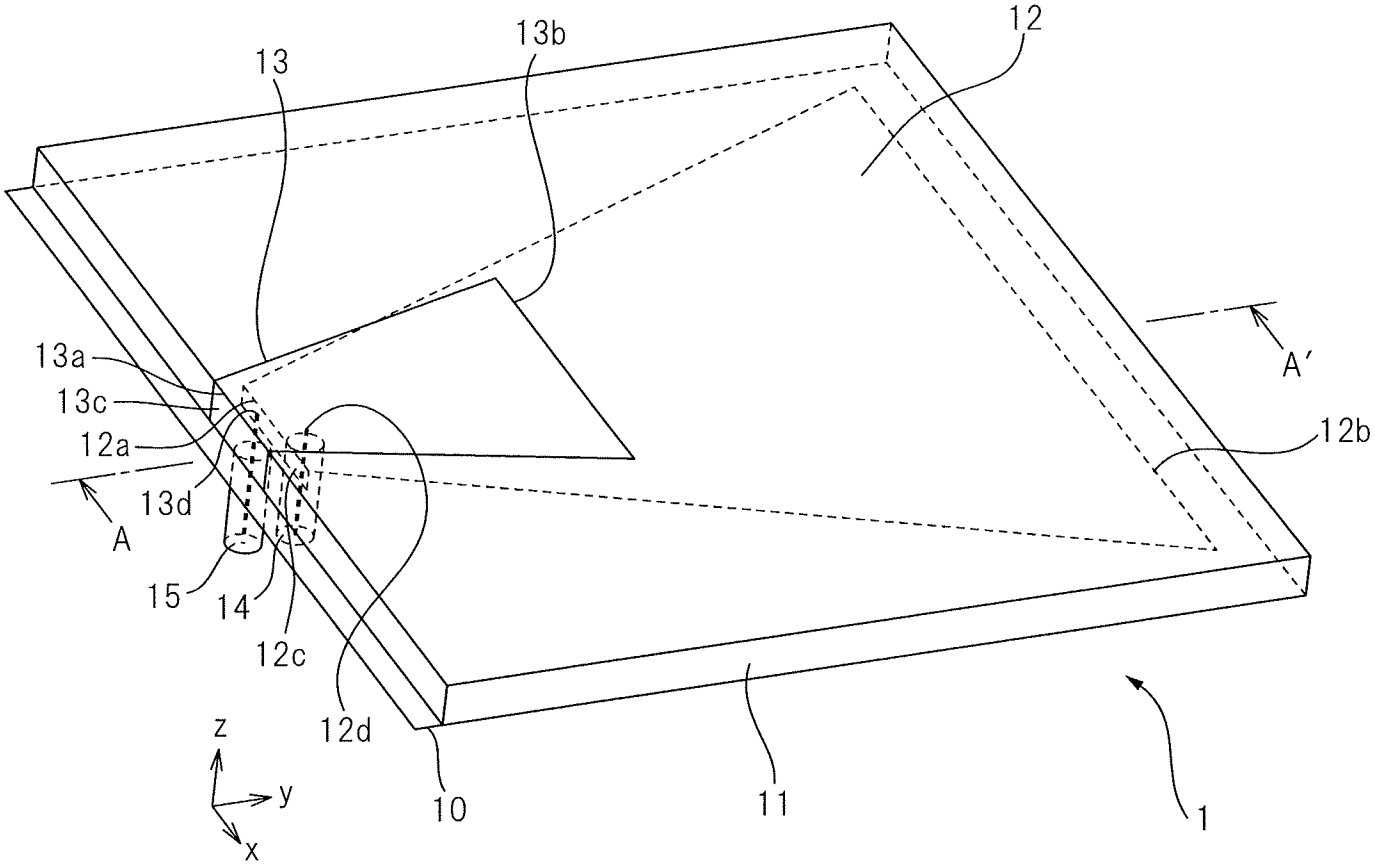
FIG. 1 is a transparent perspective view of a patch antenna according to the first embodiment.
Figure 2:
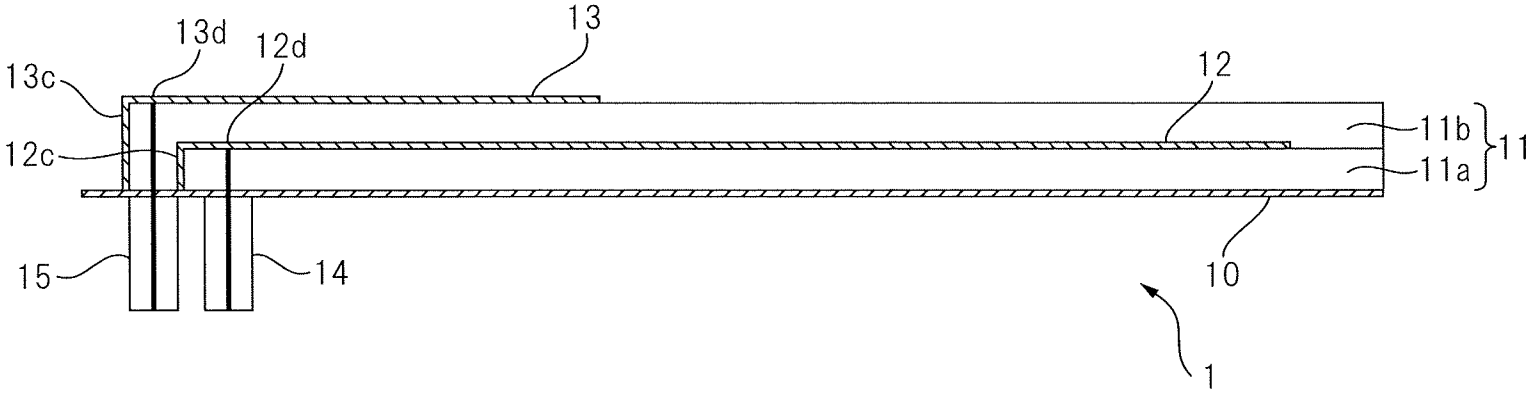
FIG. 2 is a schematic cross-sectional view of the patch antenna according to the first embodiment.

FIG. 1 is a transparent perspective view of a patch antenna according to one embodiment, and FIG. 2 is a schematic side-plane cross-sectional view of the patch antenna, seeing the A-A' line in FIG. 1 from the side of the arrows.

The patch antenna 1 includes a ground electrode 10, a substrate 11, a low frequency patch 12 which is provided in the substrate 11, and a high frequency patch 13 which is provided on the top surface of the substrate 11. Furthermore, the patch antenna 1 includes a feeding line 14 which feeds power to the low frequency patch 12, and a feeding line 15 which feeds power to the high frequency patch 13. When the patch antenna 1 is used in a BAN, the patch antenna 1 is mounted on the human body such that, for example, the bottom surface of the substrate 11 in FIG. 2, i.e., the ground electrode 10, faces the surface of the human body.

Below the ground electrode 10, an insulating layer (not illustrated) for supporting the patch antenna 1 and a communication circuit (not illustrated) which communicates with other communication devices using the patch antenna 1, may be provided.

The ground electrode 10 is a planar conductor that is grounded, and is arranged on a bottom surface of the substrate 11. The ground electrode 10 is larger than the low frequency patch 12 and the high frequency patch 13, and, seeing the patch antenna 1 from above, the ground electrode 10 is arranged to overlap with the low frequency patch 12 and the high frequency patch 13 entirely.

The substrate 11 is formed with a dielectric, and is an example of a dielectric layer that supports the ground electrode 10, the low frequency patch 12 and the high frequency patch 13, certain intervals apart. The thickness of the substrate 11 is set according to the permittivity of the material forming the substrate 11, such that the low frequency patch 12 resonates at the first frequency and the high frequency patch 13 resonates at a second frequency.

Furthermore, the substrate 11 includes a lower layer 11*a* which is arranged between the low frequency patch 12 and the ground electrode 10, and an upper layer 11*b* which is arranged between the low frequency patch 12 and the high frequency patch 13. The lower layer 11*a* and the upper layer 11*b* of the substrate 11 are fixed by, for example, bonding.

In an upper surface of the lower layer 11*a*, for example, a pocket that substantially matches the outer diameter of the low frequency patch 12 is formed, and the low frequency patch 12 is arranged in the pocket. Then, the upper layer 11*b* of the substrate 11 is arranged above the low frequency patch 12 and the lower layer 11*a*, so that, further outside the pocket, the lower layer 11*a* and the upper layer 11*b* contact, and the low frequency patch 12 is fixed between the lower layer 11*a* and the upper layer 11*b*.

The low frequency patch 12 receives a signal having the lower first frequency between the two frequencies which the patch antenna 1 can use, from a communication circuit (not illustrated) via the feeding line 14, and radiates the signal in the air as a radio signal. Alternatively, the low frequency patch 12 receives a radio signal having the first frequency and passes the signal to the feeding line 14 as an electric signal. The radio signal with the first frequency is used, for example, for communication between a plurality of communication devices mounted on the human body.

The low frequency patch 12 is a planar conductor that is formed in the shape of a trapezoid, and is arranged between the lower layer 11*a* and the upper layer 11*b* of the substrate 11, substantially parallel to the ground electrode 10. In the present embodiment, the low frequency patch 12 is formed in the shape of an isosceles trapezoid so as to have uniform radiation characteristics in the plane that is parallel to the surface of the patch antenna 1.

Furthermore, in order to make the area of the low frequency patch 12 small, the short side 12*a* of the low frequency patch 12 is electrically coupled with the upper end of a sidewall conductor 12*c* that is formed vertical, and, on the other hand, the lower end of the sidewall conductor 12*c* is electrically coupled with the ground electrode 10. On the other hand, the long side 12*b* of the low frequency patch 12 is an open end. Furthermore, the low frequency patch 12 is connected with the feeding line 14 at a feeding point 12*d*, which is provided closer to the short side 12*a* than to the long side 12*b*. The distance from the short side 12*a* to the feeding point 12*d* is determined such that the first frequency is a resonant frequency.

Since the low frequency patch 12 is formed as illustrated above, the current to flow on the surface of the low frequency patch 12 is mainly in the lowest TM mode, i.e., TM01 mode. Consequently, intensity of electric wave that is radiated in the direction parallel to the surface of the low frequency patch 12 is stronger than intensity of electric wave that is radiated in the direction perpendicular to the surface.

Figure 3:
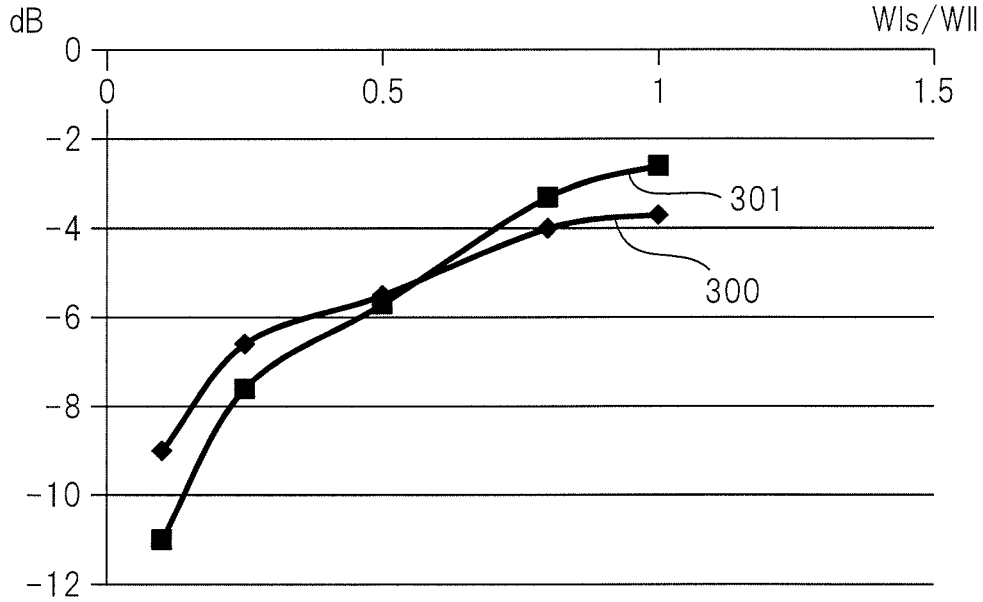
FIG. 3 is a diagram illustrating a simulation result of the relationship between the ratio of the length of the short side to the length of the long side in a patch, and the antenna gains in TM01 mode and TM10 mode.

FIG. 3 is a diagram illustrating the relationship between the ratio ($W_{ls}/W_{ll}$) of the length $W_{ls}$ of the short side 12*a* of the low frequency patch 12 to the width $W_{ll}$ of the long side 12*b*, and the antenna gains of TM01 mode and TM10 mode. In FIG. 3, the horizontal axis represents the ratio ($W_{ls}/W_{ll}$), and the vertical axis represents the gain (dB). The graph 300 represents the relationship between the antenna gain of TM01 mode, i.e., the antenna gain in the direction parallel to the surface of the low frequency patch 12, and the ratio ($W_{ls}/W_{ll}$) Furthermore, the graph 301 represents the relationship between the antenna gain of TM10 mode, i.e., the antenna gain in the direction that is orthogonal to the surface of the low frequency patch 12, and the ratio ($W_{ls}/W_{ll}$).

As illustrated in the graph 300 and the graph 301, as the ratio ($W_{ls}/W_{ll}$) becomes smaller, the ratio of the intensity of electric field radiation in the direction that is perpendicular to the surface of the patch antenna 1 with respect to the intensity of electric field radiation parallel to the surface of the patch antenna 1 increases. On the other hand, as the ratio ($W_{ls}/W_{ll}$) becomes smaller, the antenna gain with respect to both TM01 mode and TM10 mode decreases. However, in the present embodiment, the signal having the first frequency and radiated or received by the low frequency patch 12 is used, for example, for communication between communication devices mounted on the human body. In other words, since the distance between the communication devices is short, the antenna gain can be low. On the other hand, the patch antenna 1 preferably has excellent radiation characteristics in the direction that is parallel to the surface of the patch antenna 1, in the first frequency. It is preferable to set the length of the short side 12*a* such that the antenna gain in the direction parallel to the surface of the patch antenna 1 is higher than the antenna gain in the direction perpendicular to the surface of the patch antenna 1. For example, as illustrated in the graph 300 and the graph 301, for example, when the ratio ($W_{ls}/W_{ll}$) is equal to lower than 0.5, the antenna gain in the direction parallel to the surface of the patch antenna 1 is higher than the antenna gain in the direction perpendicular to the surface of the patch antenna 1. Therefore, it is preferable to set the length of the short side 12*a* such that the ratio ($W_{ls}/W_{ll}$) is equal to or lower than 0.5.

The width of the long side 12*b* of the low frequency patch 12 and the length from the short side to the long side 12*b* are set so that the first frequency is a resonant frequency.

The feeding line 14 connects the low frequency patch 12 with a communication circuit (not illustrated). In the present embodiment, the feeding line 14 is a coaxial cable which includes an inner wire that is located in the center and an outer conductor that is provided around the inner wire. The outer conductor of the feeding line 14 is electrically coupled with the ground electrode 10, and the inner wire penetrates the lower layer 11*a* of the substrate 11 and is electrically coupled with the low frequency patch 12 at the feeding point 12*d*. By this means, it is easy to make the impedance of the feeding line 14 match the impedance of the low frequency patch 12.

The high frequency patch 13 receives a signal having the higher second frequency of the two frequencies which the patch antenna 1 can use, from the communication circuit (not illustrated) via the feeding line 15, and radiates the signal in the air as a radio signal. Alternatively, the low frequency patch 12 receives a radio signal having the second frequency and passes the signal to the feeding line 15 as an electric signal. The radio signal with the second frequency is used, for example, for communication between the hub communication device mounted on the human body and communication devices located at other than the human body.

The high frequency patch 13 is a planar conductor that is formed in the shape of a trapezoid, and is arranged on a top surface of the upper layer 11*b* of the substrate 11, substantially parallel to the ground electrode 10 and the low frequency patch 12. Note that, in the present embodiment, similar to the low frequency patch 12, the high frequency patch 13 is also formed in the shape of an isosceles trapezoid.

Furthermore, in the short frequency patch 12 and the long frequency patch 13, the short sides of the two patches are located on the side of the same end of the substrate 11, and, on the side of the opposite end from the end, the long sides of the two patches are located. Furthermore, it is preferable to arrange the two patches such that the long side 13*b* of the high frequency patch 13 and the long side 12*b* of the short frequency patch 12 are substantially parallel. By this means, the high frequency patch 13 substantially overlaps the entire low frequency patch 12. Further, the high frequency patch 13 is arranged such that the feeding point 13*d* is located between the end of the substrate 11 and the short side 12*a* of the low frequency patch, to prevent the feeding line 15 that feeds power to the high frequency patch 13 from contacting the low frequency patch 12. Furthermore, as the interval between the short side 12*a* of the low frequency patch 12 and the short side 13*a* of the high frequency patch 13 becomes shorter, the area over which the low frequency patch 12 and the high frequency patch 13 overlap becomes wider, so that the size of the patch antenna 1 decreases. Meanwhile, it is preferable to arrange the feeding line 14 and the feeding line 15 separately to a certain distance so that it is possible to prevent an occurrence of electromagnetic wave interference between the signal that passes the feeding line 14 and the signal that passes the feeding line 15.

Furthermore, the low frequency patch 12 and the high frequency patch 13 are arranged such that a first center line, which connects the midpoint of the short side 12*a* with the midpoint of the long side 12*b* in the low frequency patch 12, matches a second center line that connects between the midpoint of the short side 13*a* and the midpoint of the long side 13*b* in the high frequency patch 13. The feeding point 12*d* of the low frequency patch 12 and the feeding point 13*d* of the high frequency patch 13 are located on the first center line. By this means, the patch antenna 1 is able to have line-symmetric radiation characteristics with respect to the first center line.

Furthermore, in order to make the area of the high frequency patch 13 small, the short side 13*a* of the high frequency patch 13 is electrically coupled with the upper end of a sidewall conductor 13*c* that is formed vertical, and, on the other hand, the lower end of the sidewall conductor 13*c* is electrically coupled with the ground electrode 10. On the other hand, the long side 13*b* of the high frequency patch 13 is an open end. Furthermore, the high frequency patch 13 is connected with the feeding line 15 in a feeding point 13*d*, which is provided near the short side 13*a*. The distance from the sidewall conductor 13*c* to the feeding point 13*d* is determined so that the second frequency is a resonant frequency.

Furthermore, the width of the long side 13*b* of the high frequency patch 13 and the length from the short side 13*a* to the long side 13*b* are also set so that the second frequency is a resonant frequency. The second frequency is higher than the first frequency, and therefore the high frequency patch 13 is smaller than the low frequency patch 12.

Forming the high frequency patch 13 as described above and arranging the high frequency patch 13 to overlap with the low frequency patch 12 causes electromagnetic coupling between the low frequency patch 12 and the high frequency patch 13. As a result, an electric field is produced in the perpendicular direction, and a current to flow in the surface of the high frequency patch 13 is excited in TM10 mode. As a result, intensity of electromagnetic wave to be radiated in the direction perpendicular to the surface of the high frequency patch 13, i.e., the bore sight, increases.

It is preferable to make the width of the short side 13*a* of the high frequency patch 13 narrower than the width of the short side 12*a* of the low frequency patch 12 such that electromagnetic coupling is more easily produced between the high frequency patch 13 and the low frequency patch 12.

The feeding line 15 connects between the high frequency patch 13 and a communication circuit (not illustrated). In the present embodiment, the feeding line 15 is a coaxial cable which includes an inner wire that is located in the center and an outer conductor that is provided around the inner wire. The outer conductor of the feeding line 15 is electrically coupled with the ground electrode 10, and the inner wire penetrates the substrate 11 and is electrically coupled with the high frequency patch 13 in the feeding point 13*d*. By this means, it is easy to make the impedance of the feeding line 15 match the impedance of the high frequency patch 13.

The ground electrode 10, the low frequency patch 12, the high frequency patch 13 and sidewall conductors 12*c*, 13*c* are made of metals such as copper, gold, silver and nickel, or their alloys, or other conducting materials. Furthermore, the substrate 11 is made of a glass epoxy resin such as FR-4, a phenolic resin such as polyphenyleneether, or polytetrafluoroethylene. Alternatively, the substrate 11 may be another dielectric that can be formed in layers.

A simulation result of the radiation characteristics of the patch antenna 1 will be explained below. In this simulation, the first frequency is 954 MHz, and the second frequency is 2.415 GHz. Furthermore, the relative permittivity of the substrate 11 is 3.1, and the tangent delta is 0.002. In addition, the thickness of the substrate 11 is 1.6 mm, and the interval between the ground electrode 10 and the low frequency patch. 11 and the interval between the low frequency patch 11 and the high frequency patch 12 are both 0.8 mm. The width of the ground electrode 10 in the direction parallel to the long side 12*b* of the low frequency patch 12 is 37.4 mm, and the length of the ground electrode 10 in the direction orthogonal to the long side 12*b* of the low frequency patch 12 is 35.4 mm. Furthermore, the width of short side 12*a* of the low frequency patch 12 and the width of the sidewall conductor 12*c* are 6 mm, and the width of the long side 12*b* is 33.65 mm. In addition, the length from the short side 12*a* to the long side 12*b* in the low frequency patch 12 is 30.15 mm. Furthermore, the width of the short side 13*a* of the high frequency patch 13 and the width of the sidewall conductor 13*c* are 5 mm, and the width of the long side 13*b* is 13.9 mm. In addition, the length from the short side 13*a* to the long side 13*b* in the high frequency patch 13 is 12.65 mm.

The size of each part is simply one example, and the size of each part of the patch antenna 1 may be set as appropriate depending on the frequency of the signal to be used, the physical characteristics of the material of each part, and/or the like.

Figure 4A:
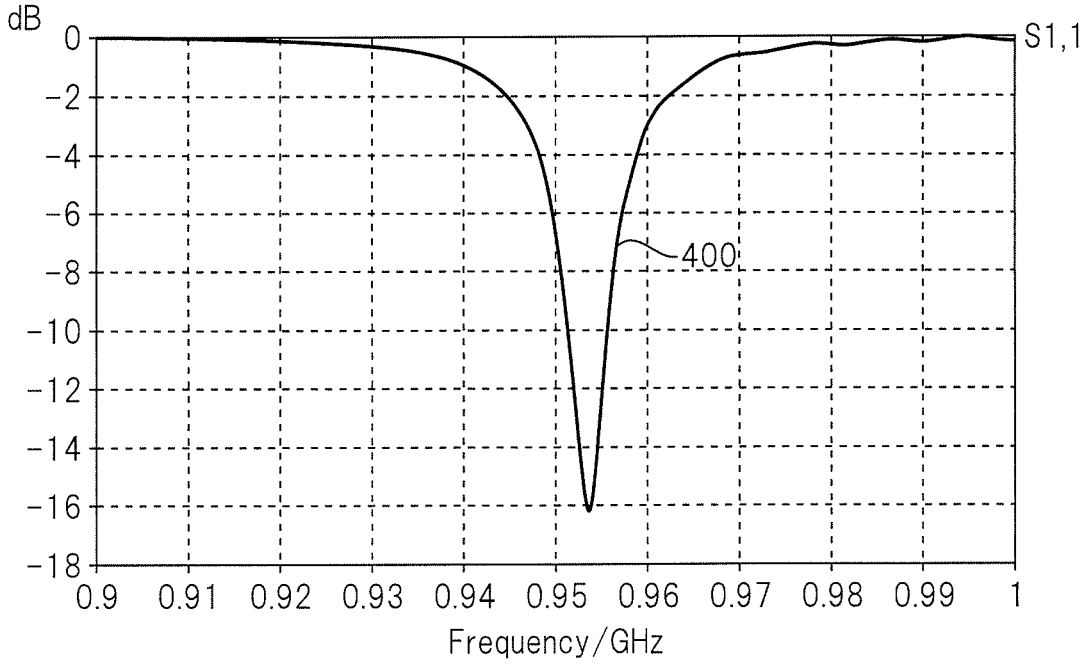
FIG. 4A is a diagram illustrating a simulation result of an S11 parameter near 950 MHz.
Figure 4B:
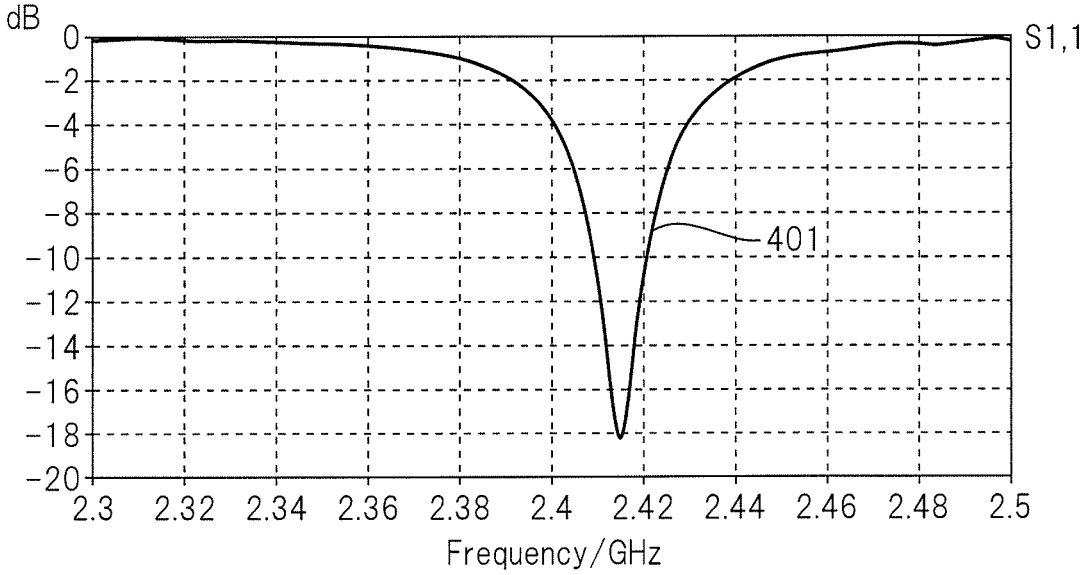
FIG. 4B is a diagram illustrating a simulation result of an S11 parameter near 2.4 GHz.

FIG. 4A is a diagram illustrating a simulation result of an S11 parameter near 950 MHz, and FIG. 4B is a diagram illustrating a simulation result of the S11 parameter near 2.4 GHz. In FIG. 4A and FIG. 4B, the horizontal axis represents frequency (GHz), and the vertical axis represents the absolute value of the S11 parameter in the decibel. The graph 400 illustrates the simulation. values of the 511 parameter of the patch antenna 1 in a frequency band near 950 MHz. On the other hand, the graph 401 illustrates the simulation values of the S11 parameter of the patch antenna 1 in a frequency band near 2.4 GHz.

As illustrated in the graph 400, near 954 MHz, the value of the S11 parameter is equal to or lower than −10 dB, which is a measure of good antenna characteristics. Furthermore, as illustrated in the graph 401, near 2.415 GHz, the value of the S11 parameter is equal to or lower than −10 dB, which is a measure of good antenna characteristics.

Figure 5A:
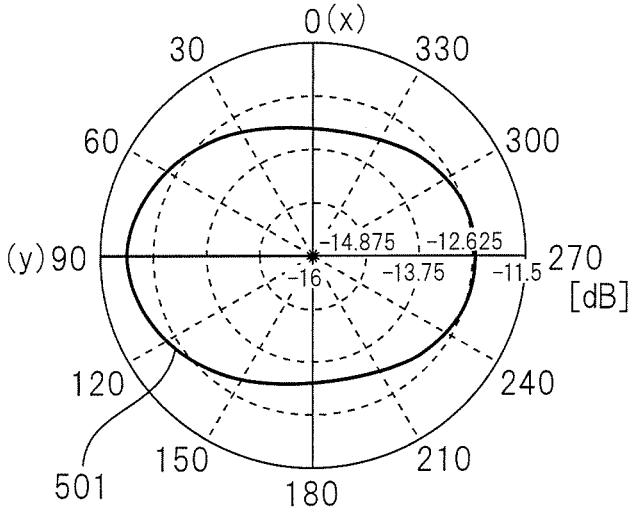
FIGS. 5A to 5C are each diagram illustrating a simulation result of far-field antenna gain of a patch antenna with respect to the frequency 954 MHz.
Figure 5B:
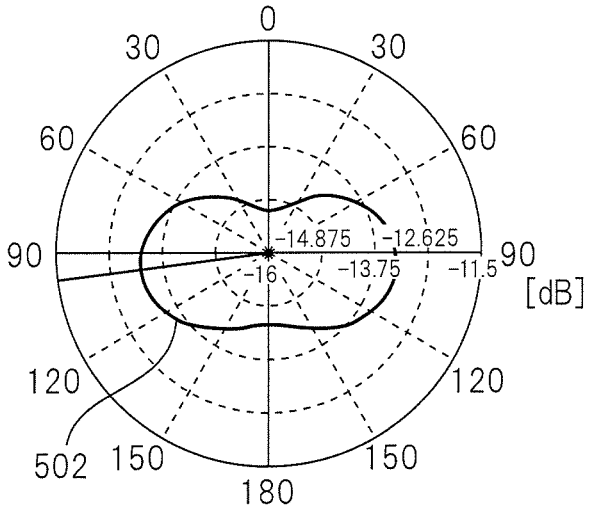
Figure 5C:
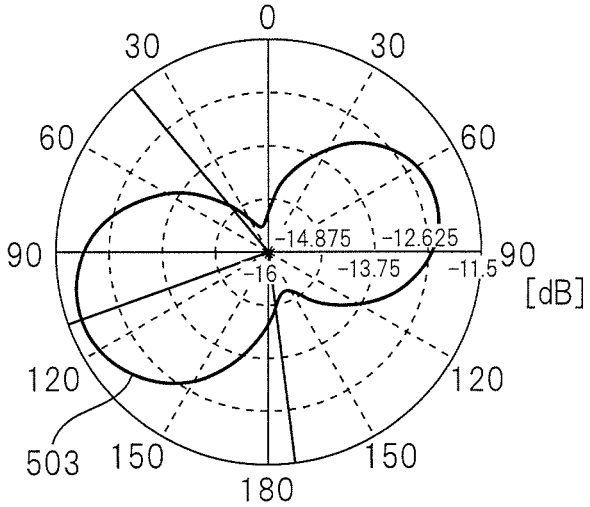

FIG. 5A to FIG. SC are each a diagram illustrating a simulation. result of the far-field antenna gain of the patch antenna 1 with respect to the frequency 954 MHz. In FIG. 5A to FIG. 5C, as illustrated in FIG. 1, the x axis represents the direction that is parallel to the long side of the low frequency patch 12 and the long side of the high frequency patch 13, in a plane that is parallel to the surface of the patch antenna 1. The y axis represents the direction that is orthogonal to the long side of the low frequency patch 12 and the long side of the high frequency patch 13, in a plane that is parallel to the surface of the patch antenna 1. The z axis represents the direction that is perpendicular to the surface of the patch antenna 1. Consequently, in the state in which the patch antenna 1 is mounted on the surface of the human body, the x axis and the y axis are directions that are substantially parallel to the surface of the human body, and the z axis is a direction that is substantially perpendicular to the surface of the human body.

The graph 501 illustrated in FIG. 5A represents the far-field gain (dB) of the patch antenna 1 with respect to the frequency 954 MHz in the xy plane, i.e., the plane that is parallel to the surface of the patch antenna 1. The graph 502 illustrated in FIG. 5B represents the far-field gain (dB) of the patch antenna 1 with respect to the frequency 954 MHz in the xz plane. The graph 503 illustrated in FIG. 50 represents the far-field gain (dB) of the patch antenna 1 with respect to the frequency 954 MHz in the zy plane.

As illustrated in the graphs 501 to 503, in the patch antenna 1, in the frequency 954 MHz, the gain along the plane that is parallel to the surface of the patch antenna 1 is higher than the gain in the direction that is perpendicular to the surface of the patch antenna 1. Consequently, in the frequency 954 MHz, mainly, an electric field is radiated along the plane that is parallel to the surface of the patch antenna 1.

Figure 6A:
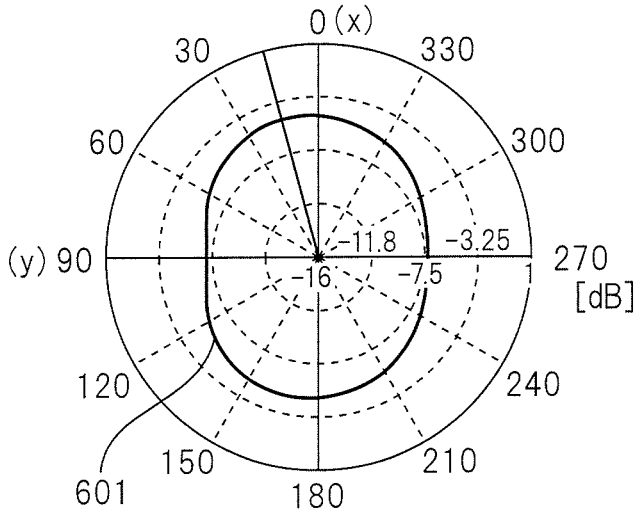
FIGS. 6A to 6C are each a diagram illustrating a simulation result of far-field antenna gain of a patch antenna with respect to the frequency 2.415 GHz.
Figure 6B:
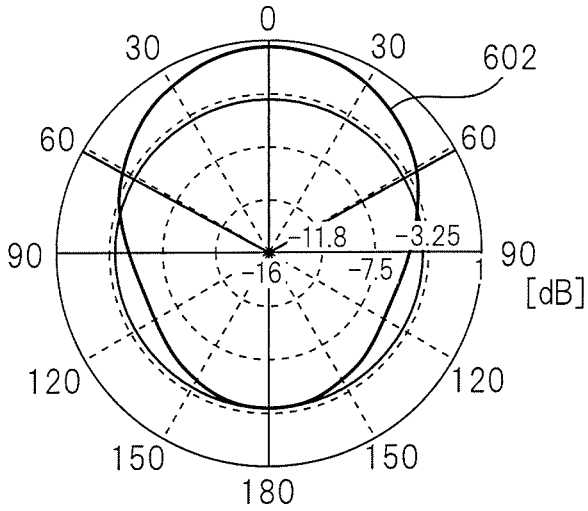
Figure 6C:
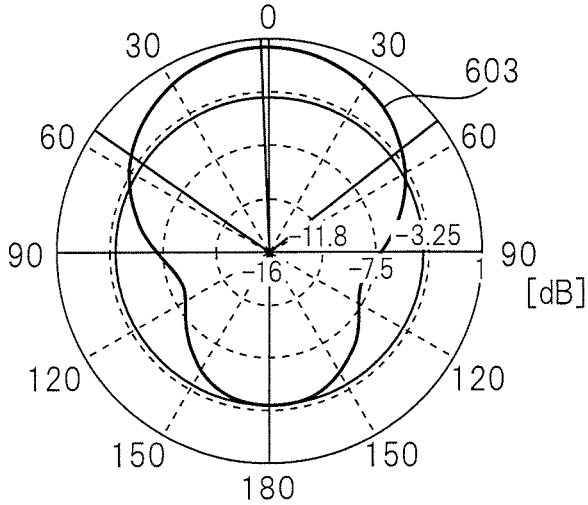

FIG. 6A to FIG. 6C are each a diagram illustrating a simulation result of the far-field antenna gain of the patch antenna 1 with respect to the frequency 2.415 GHz.

The graph 601 illustrated in FIG. 6A represents the far-field gain (dB) of the patch antenna 1 with respect to the frequency 2.415 GHz in the xy plane, i.e., the plane that is parallel to the surface of the patch antenna 1. The graph 602 illustrated in FIG. GB represents the far-field gain (dB) of the patch antenna 1 with respect to the frequency 2.415 GHz in the xz plane. The graph 603 illustrated. in FIG. 6C represents the far-field gain (dB) of the patch antenna 1 with respect to the frequency 2.415 GHz in the zy plane.

As illustrated in the graphs 601 to 603, in the patch antenna 1, in the frequency 2.415 GHz, the gain in the direction that is perpendicular to the surface of the patch antenna 1 is higher than the gain in the direction that is parallel to the surface of the patch antenna 1. Consequently, in the frequency 2.415 GHz, mainly, an electric field is radiated in the direction that is perpendicular to the surface of the patch antenna 1.

Note that simulation values illustrated in FIG. 3 to FIG. 6 are calculated by electromagnetical field simulations using the finite integration method.

As has been described above, the patch antenna includes a structure of stacking three layers of planar conductors, and therefore is small in size in the direction of height. Furthermore, in the patch antenna, each of patches is formed in the shape of a trapezoid, so that the size in the plane that is parallel to the surface of the patch antenna is also small. Consequently, the patch antenna is suitable for use for communication devices to be mounted on the human body. Furthermore, in the first frequency, the patch antenna has better radiation characteristics in a plane that is parallel to the surface of the patch antenna than the radiation characteristics in the direction perpendicular to the surface, and, in the second frequency, by contrast, has better radiation characteristics in the direction that is perpendicular to the surface of the patch antenna than the radiation characteristics in the plane that is parallel to the surface. Consequently, the patch antenna is suitable for use in a BAN, and, in particular, suitable for use as an antenna of a hub communication device.

All of the examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. A patch antenna comprising:

a dielectric layer;

a ground electrode, which is arranged on one surface of the dielectric layer;

a first patch, which is conductive, formed in a shape of a trapezoid, and arranged inside the dielectric layer, to be parallel with the ground electrode, and which transmits a signal having a first frequency, or receives the signal having the first frequency;

a second patch, which is conductive, formed in a shape of a trapezoid, and arranged on the other surface of the dielectric layer, to be parallel with the first patch, and which transmits a signal having a second frequency, which is higher than the first frequency, or receives the signal having the second frequency;

a first conductor, which electrically couples a short side of the first patch with the ground electrode; and a second conductor, which electrically couples a short side of the second patch with the ground electrode, wherein the first patch and the second patch are arranged such that the short side of the first patch and the short side of the second patch are located on a side of a first end of the dielectric layer and a long side of the first patch and a long side of the second patch are located on a side of a second end, which opposes to the first end;

the first patch is fed power via a first feeding point, which is closer to the short side of the first patch than the long side of the first patch, and the second patch is fed power via a second feeding point, which is located between the first end and the short side of the first patch;

an intensity of radiation in the first frequency along a plane that is parallel to a surface of the first patch is stronger than an intensity of radiation in the first frequency in a direction that is perpendicular to the surface of the first patch; and an intensity of radiation in the second frequency in a direction that is perpendicular to the surface of the second patch is stronger than an intensity of radiation in the second frequency along a plane that is parallel to a surface of the second patch.

2. The patch antenna according to claim 1, wherein the width of the short side of the first patch is equal to or less than a width of the long side of the first patch.

3. The patch antenna according to claim 1, wherein the first patch and the second patch are each formed in a shape of an isosceles trapezoid, the first patch and the second patch are arranged such that a first center line which passes a midpoint of the short side of the first patch and a midpoint of the long side of the first patch matches a second center line which passes a midpoint of the short side of the second patch and a midpoint of the long side of the second patch, and the first feeding point and the second feeding point are located on the first center line.

* * * * *